United States Patent [19]

Andreasson

[11] Patent Number: 4,488,687

[45] Date of Patent: Dec. 18, 1984

[54] METHOD AND ARRANGEMENT FOR CONTINUOUSLY WINDING-UP A WEB OF MATERIAL

[75] Inventor: Bengt A. Andreasson, ÅmÅl, Sweden

[73] Assignee: Aktiebolaget Amals Mekaniska Verkstad, Sweden

[21] Appl. No.: 494,059

[22] Filed: May 12, 1983

[30] Foreign Application Priority Data

May 26, 1982 [SE] Sweden ..... 8203265

[51] Int. Cl.[3] ..... B65H 19/20

[52] U.S. Cl. ..... 242/56 A; 242/64

[58] Field of Search ..... 242/56 A, 64

[56] References Cited

U.S. PATENT DOCUMENTS

| | | | |
|---|---|---|---|
| 2,586,833 | 2/1952 | Kohler et al. | 242/56 A |
| 2,772,054 | 11/1956 | Herele et al. | 242/56 A X |
| 2,787,427 | 4/1957 | Marczincsin | 242/56 A |
| 2,950,873 | 8/1960 | Nelson | 242/56 A |
| 2,973,158 | 2/1961 | Zernov | 242/56 A |
| 3,207,452 | 9/1965 | Haskin et al. | 242/64 |
| 3,547,365 | 12/1970 | Loase et al. | 242/56 A |
| 4,058,267 | 11/1977 | Schüttler | 242/56 A |
| 4,171,780 | 10/1979 | Bugnone | 242/56 A |
| 4,337,903 | 7/1982 | Kessler et al. | 242/56 A |

FOREIGN PATENT DOCUMENTS

| | | | |
|---|---|---|---|
| 2205683 | 8/1972 | Fed. Rep. of Germany | 242/56 R |
| 870716 | 6/1961 | United Kingdom | 242/64 |

*Primary Examiner*—Stanley N. Gilreath
*Assistant Examiner*—Joseph J. Hail, III
*Attorney, Agent, or Firm*—Murray, Whisenhunt & Ferguson

[57] ABSTRACT

In a method and an apparatus for continuous winding-up of a material web on roll spindles where the web is supplied continuously and is arranged to be cut off in conjunction with roll spindle shiftings, a cutting off knife (17) is mounted in a holder (10) together with a brush (16) and a pressure roller for transferring the web onto a new roll spindle. The invention also includes a microcomputer-regulated control system and a gear drive housing (44) which is designed to be rotated together with the roll holder (5) during spindle shiftings.

13 Claims, 6 Drawing Figures

METHOD AND ARRANGEMENT FOR CONTINUOUSLY WINDING-UP A WEB OF MATERIAL

TECHNICAL FIELD

The present invention relates to a method and an apparatus for the continuous winding-up of a web material on roll spindles. It relates particularly to a method and an apparatus for winding-up subject to contolled tension of the material web. The winding-up apparatus is intended for material webs which are fed continuously to the apparatus, and where the winding-up apparatus includes devices for cutting off the material web in conjunction with the shifting of roll spindles.

BACKGROUND

With continuous printing presses and similar machines where the web material fed out has to be wound up on roll spindles, a plurality of systems have been developed for shifting the roll spindles without interrupting the feed of the web material. As a rule these known systems include some form of web material buffer store in the form of an extra loop which can be enlarged in conjunction with a transient reduction in the winding-up speed when the material web is to be cut off so as to enable the roll to be shifted. Generally the known methods and apparatuses of this type have the disadvantage that the acceleration and retardations in conjunction with winding-up, and particularly during the initial stage of winding-up, result in uncontrolled stretching of the material web which in turn results in uneven winding-up, problems of registration and the like in the preceeding rotary printing press.

It is also conventional to have some form of metrological coupling or drive from the rotary printing press or the like which is served by the winding-up unit. However experience has indicated that these couplings can easily give rise to oscillations in the control system. This causes variations in web tension which in turn result in winding-up becoming uneven. In many cases the stretch of the web material is not optimum. One consequence of these problems is that with conventional arrangements there are often gaps between the turns on the roll, which naturally renders this less compact and more uneven. In such cases the rolls can easily become distorted and be difficult to handle. A disadvantage of existing systems is also that generally it is difficult to reproduce the good winding-up results obtained in favourable cases. This applies particularly, if the winding-up unit is to be employed with a variety of web material grades.

DESCRIPTION OF THE INVENTION

The aim of the present invention is to provide a method and an apparatus which can solve the problems specified above. A particular aim is to provide a method and an apparatus which permit continuous and uniform winding-up. A particular aim is that of being able to avoid gaps between the layers so as to obtain extremely compact rolls, in that tensions are incorporated in the roll which vary in a controlled manner from the centre outwards, all with the aim of giving the desired hardness and uniformity in the roll.

One aim is also to provide a method an an apparatus which function reliably and reproducibly and which can be employed for differing qualities of paper and other web materials. These and other objectives can be achieved in that the invention is characterised by what is specified in the patent claims which follow. Further characteristics and advantages of the invention will be indicated by the following description of a preferred embodiment.

BRIEF DESCRIPTION OF DRAWINGS

In the following description of a preferred embodiment reference is made to the appended diagrams where.

BEST MODE OF CARRYING OUT THE INVENTION

Figure 1:
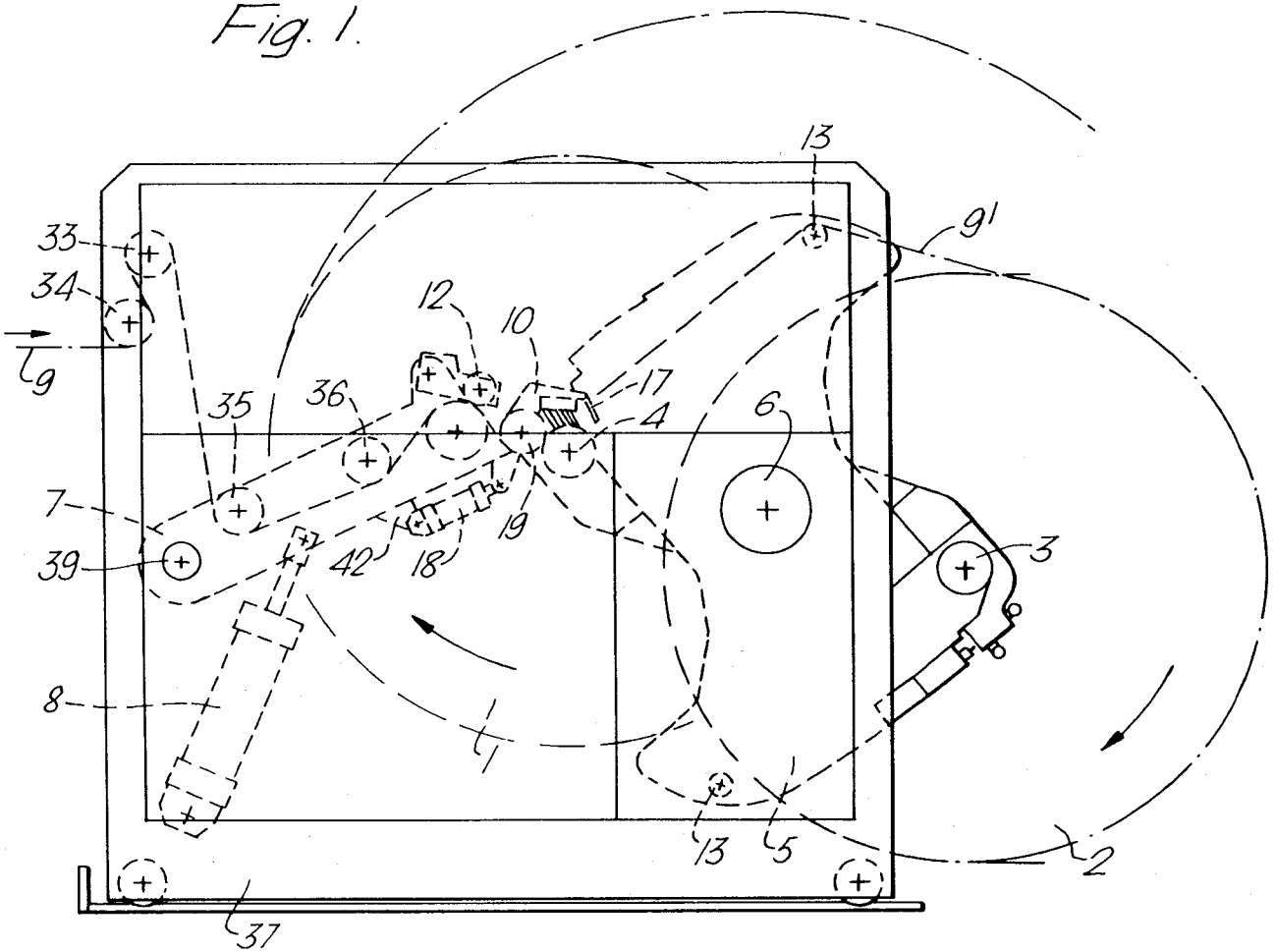
FIG. 1 is a side view from the right of an apparatus for winding-up a material web.

The apparatus illustrated in FIG. 1 comprises a roll holder 5 revolvable around a rotary shaft 6 for two roll spindles 3 and 4. The roll holder 5, FIG. 2, consists of two end sections or yokes 31, 31' which are mutually connected by means of two rollers 13 which are deflector rollers in the unit. Furthermore the yokes 31, 31' are held together in a known manner by a pair of interconnecting bars, not shown, which provide the required rigidity to the roll holder.

The roll holder 5 with the two rotatable, driven spindles 3 and 4 can be revolved around an axis of revolution 6 by a drive arrangement 52 which permits revolution of the roll holder 5 in both directions so as to permit shifting of the spindle positions. During such revolution of the roll holder 5 the spindles 3 and 4 change places. The shafts which appertain to the spindles 3 and 4 and the axis of revolution 6 are located in the same plane. Furthermore the axis of revolution 6 of roll holder 5 is located in the centre, right between the axes of rotation of the spindles 3 and 4.

In FIG. 1 the material web is designated as 9. This is guided past an initial deflector roller 34, a second deflector roller 33 which also functions as measuring roller, further deflector rollers 35, 36 and 11, a pressure roller 19 and the upper deflector roller 13, after which the web is wound up on the roll 2 which as shown in FIG. 1 has been wound up almost completely and is transferred to the position for the right-hand spindle 3.

Figure 3:
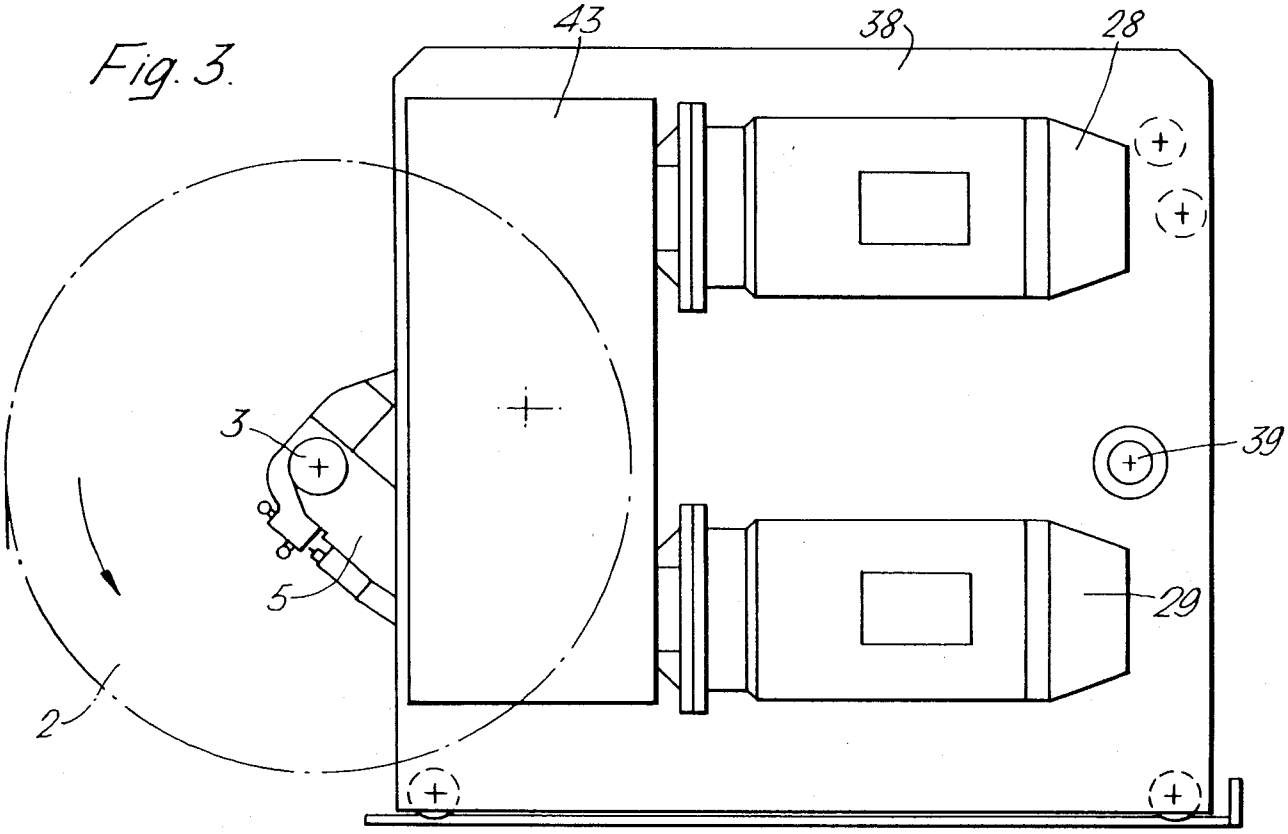
FIG. 3 is a side view of the same apparatus as in FIG. 1, but viewed from the left.
Figure 4:
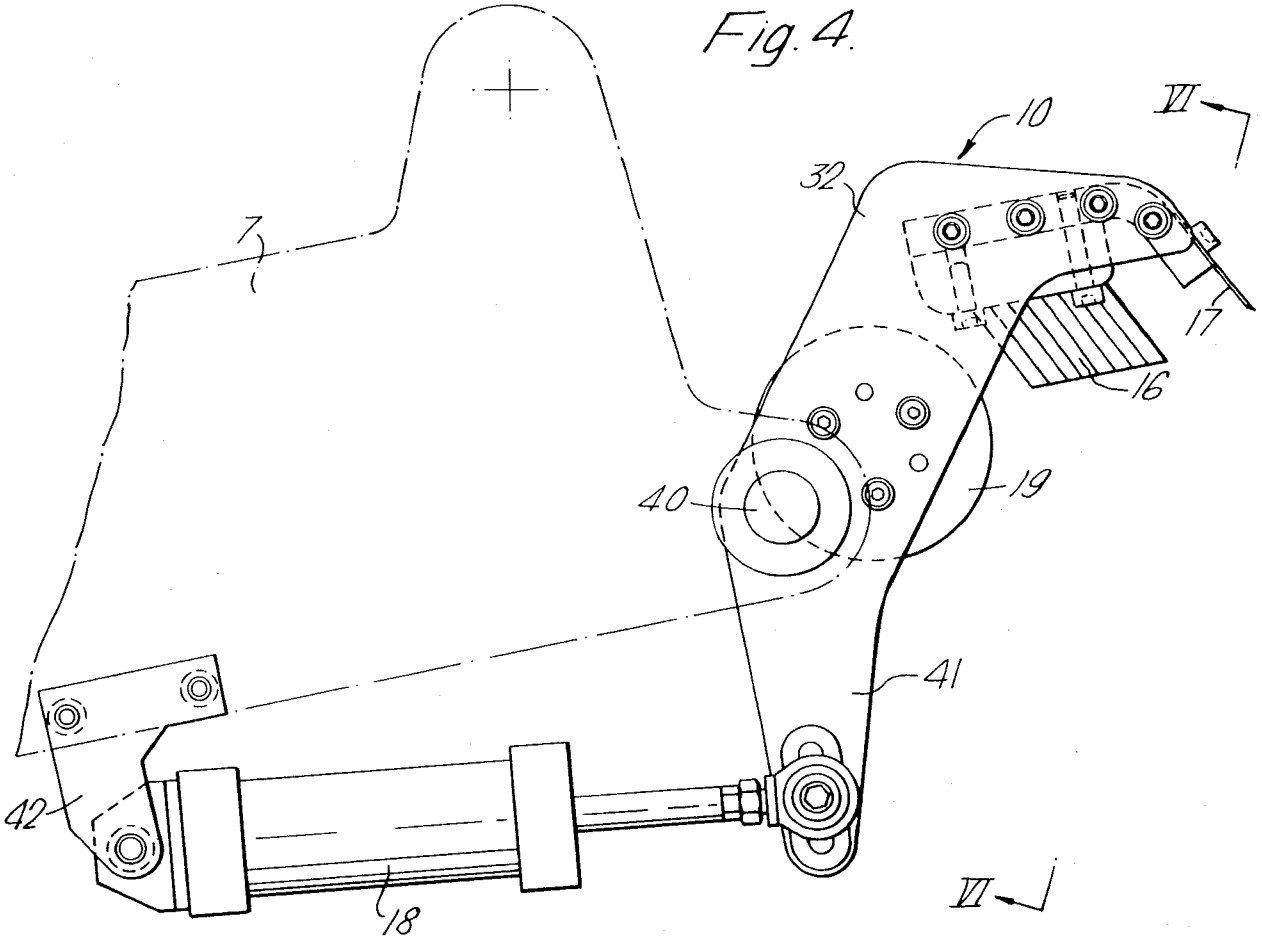
FIG. 4 shows a combined device for cutting off the material web and transference of the cut off end, which now represents the leading end of the web, to a spindle in the winding-up position.
Figure 5:
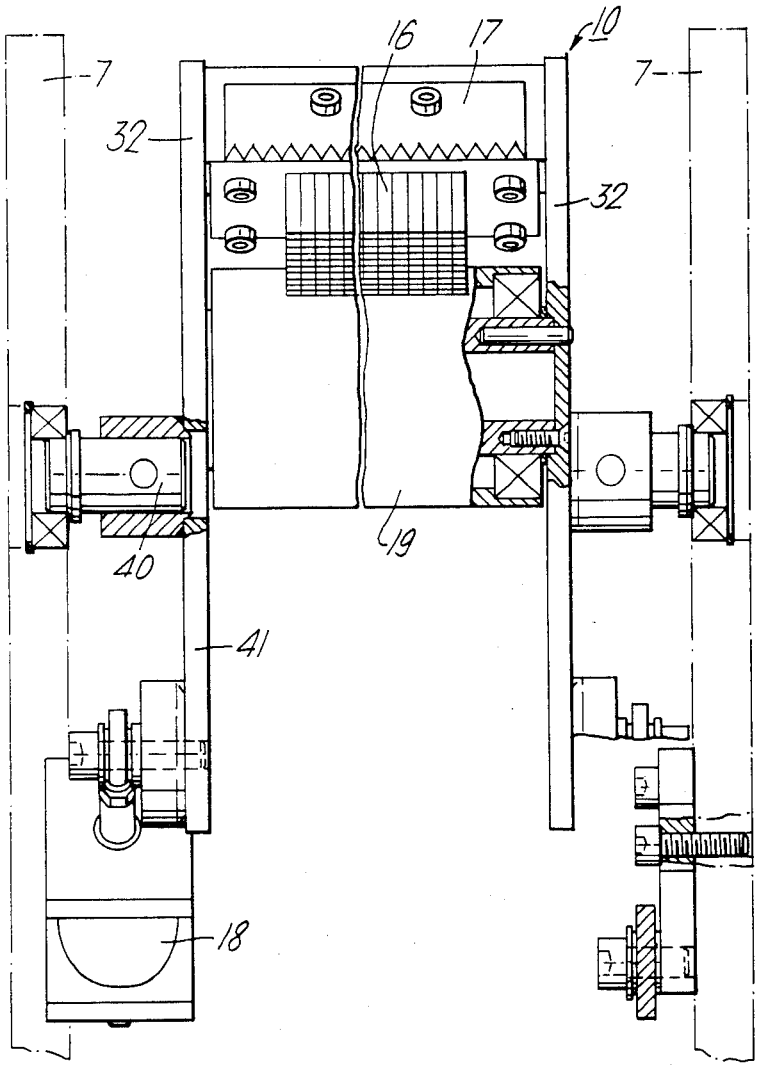
FIG. 5 is a view VI—VI in FIG. 4.

The three deflector rollers 35, 36 and 11 are mounted in two shifting levers 7 which in turn are pivotally mounted in two lateral frame end sections 37 and 38, FIG. 1 and FIG. 3 of the apparatus. The axis of pivotal movement of the levers 7 is designated as 39. The shifting levers 7 can be pivoted by one or by a pair of cylinders 8. The shifting levers 7 furthermore support a unit 10 which is shown in greater detail in FIG. 4. The combined unit 10 is designated to cut off the web of material and transfer the cut-off leading end of the web onto spindle 4 which is located in the winding-up position. A cutting knife is designated as 17. A brush 16 is located at the front of the knife 17, as viewed in the direction of movement of the web 9. Somewhat further back still there is the counter-pressure roller 19. All these three components, i.e. the knife 17, brush 16 and roller 19, are supported by a pair of two-armed levers 32 which can pivot around a pivot 40 on the shifting lever 7 by means of a pair of cylinders 18 located between the rear arm 41 of lever 32 and the mounting lug 42 on each shifting lever 7.

FIG. 1 also shows a cutting device 12 which can cut the material web 9 into a plurality of cut parallel material webs located side by side which are wound up simultaneously and in parallel after being cut.

Figure 6:
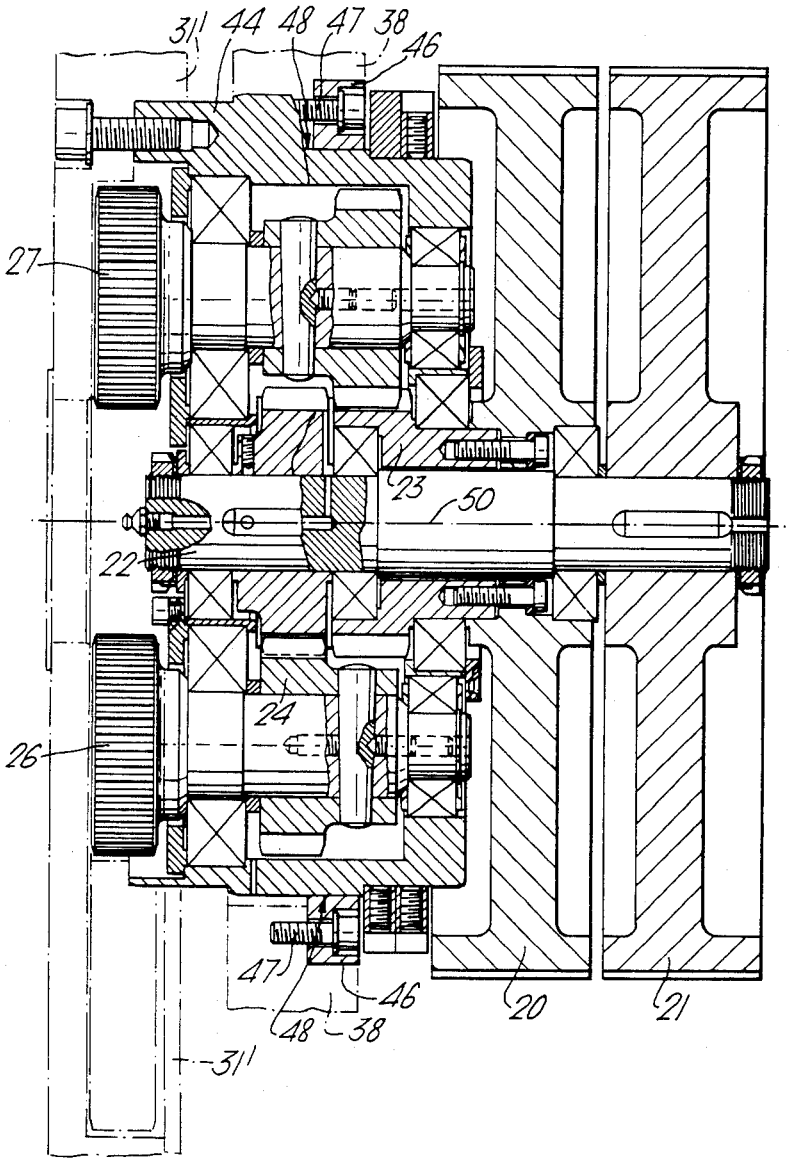
FIG. 6 shows a transmission device, partly in section, which is designed to transfer the twisting movement to the spindles from a drive motor which is allocated to each spindle.

The unit illustrated in the diagrams is provided with two electric drive motors 28 and 29, FIG. 3, which via a gear transmission are designed to transmit a torque to the spindle shafts 3 and 4. Motors 28 and 29 are connected with shafts 3 and 4 respectively. Hence when the roll holder 5 revolves for example one-half a revolution and the spindles thus shift their positions, the spindles retain their interconnection with their respective drive motors. Each drive motor is, via toothed belt transmissions, connected with a pair of wheels 20 and 21, as shown in FIG. 6. Via a shaft 22 the wheel 21 is connected with a gear drive 24 which in turn, via a gear wheel transmission, is connected with a gear wheel 26, which via an intermediate wheel transmits the rotary movement of one motor to one of the spindles. The wheel 20 which is connected with the other motor transmits its movement and its torque via a sleeve-shaped gear drive 23 to a gear wheel 27 which via intermediate wheels is connected with and transmits torque and rotation to the other spindle. The gear wheels 27 and 26 are located in the left-hand yoke 31′ in the revolutionary roll holder 5. The two electric drive motors 28 and 29 are mounted on the left-hand end section 38 and each drives its wheel 20 or 21 respectively via direct-mounted mitre-wheel gears, not shown, and the said belt transmission. The wheels 20 and 21, shaft 22 and gear drives 23 and 24 are coaxial with the axis of rotation 6 of the roll holder, which is mounted in the end section 37 on the opposite side of the unit and arranged to be rotated by the said drive arrangement, which is not shown in FIG. 1, but which is also mounted on the said right-hand end section 37.

Referring again to FIG. 6, a gear housing is denoted by 44. The gear housing 44 is arranged inside the two wheels 20 and 21 which in turn are located under a cover which, together with the entire transmission, is designated as 43 in FIG. 3. The gear housing 44 is attached to the left-hand yoke 31′ of the roll holder 5 by a number of bolts. A supporting and bearing flange 46 which is recessed in the left-hand end section 38 is attached to the end section 38 by a number of bolts 47. The gear housing 44 with its cylindrical surface 48 is slidably mounted in the flange 46. The two gear wheels 26 and 27 which are arranged to drive the two wheel spindles 3 and 4 in the roll holder 5 are located in a cylindrical recess 49 in the roll holder yoke 31′.

Figure 2:
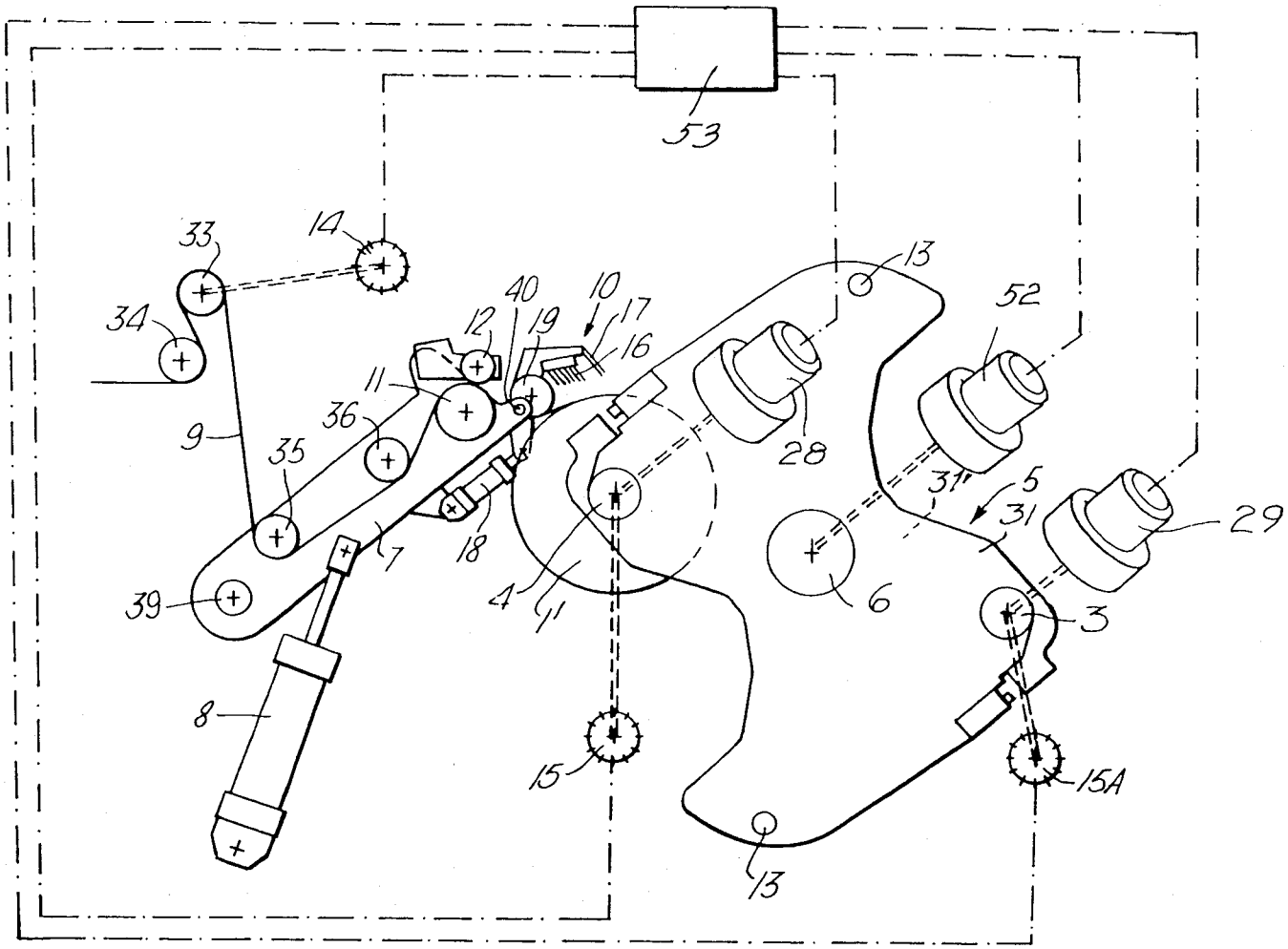
FIG. 2 illustrates a number of components of the apparatus as shown in FIG. 1, which are particularly characteristic of the invention, in a position where winding-up on a spindle in the winding-up position has proceeded to such an extent that the roll diameter has reached a size corresponding to roughly one-third of its final diameter.

The automatic control system will now be explained by reference to FIG. 2. An impulse emitter shown schematically, designated 14, is connected to the deflector and measuring roller 33. The impulse emitter 14 is so designed that it generates a pulse train, the impulse sequence of which is proportional to the speed of the deflector and measuring roller 33 and thus also proportional to the speed of the web 9. An impulse emitter 15 is assigned to the winding-up spindle 4 and an impulse emitter 15A is connected in a corresponding manner to the second spindle 3. The impulse emitters 15 and 15A generate pulse trains, the frequencies of which are proportional to the speed of the spindles 4 and 3 respectively. The pulse trains from impulse emitters 14, 15 and 15A are transferred to a computer which is programmed in such a way that it transmits guide signals to the drive motors 28 and 29 of spindles 4 and 3, so that the material web 9 is always given the desired tension and the empty roll spindle which stands ready to take over the leading end of the web always has the correct speed during the initial stage. Information is also stored in the computer regarding different material qualities, so that an adequate tension can always be maintained in the web for each web material. The computer 53 to which the signals are transmitted from impulse emitters 14, 15 and 15A can be of a type already known and has not been illustrated in the diagrams. Knowing the number of pulses per revolution of roller 33 generated by the impulse emitter 14, and the diameter of roller 33, and knowing the number of pulses per revolution for spindles 3 and 4 generated by impulse emitters 15 and 15A, there is no difficulty in designing and programming a micro-computer which calculates and controls the drive motors 28 and 29 so that these always provide the necessary torque on the drive shafts of spindles 3 and 4 in order to maintain the requisite tension in the material web, and also provide the desired speed of the spindles independent of each other and of the diameter of the wound up roll. The number of pulses per revolution of roller 33, generated by the impulse emitter 14, and the number of pulses per revolution of spindles 3 and 4 generated by impulse emitter 15 and 15A is here so chosen that it is possible to obtain the necessary information over an extremely short length of web as this passes by for the computer to supply the correct control value to the drive units so that the correct torque and thus always the desired speed and tension are obtained in the web. The method of operation of the apparatus described will now be explained in the following description of a cycle of operation. The starting position here can be the position as illustrated in FIG. 1. The roll 2 has reached its full diameter. The web 9 has just been cut by the knife 17 and only the rear end 9′ is left to be wound up on roll 2. The leading end of the cut web 9 has been taken by the brush 16 and pressure roller 19 to the empty roll spindle 4 which has been provided with a glue coating. After this, winding-up continues on roll spindle 4, whilst throughout the entire period the pressure roller 19 presses against the web 9 with the roll spindle 4 and the new roll, which gradually increases in size, acting as counter-pressure rolls. Hence roller 19 functions both as a deflector roller and as a pressure roller. Gradually, as the roll increases in size, i.e. roll 1′ in FIG. 2, the roll 1′ increasing in size presses the shifting lever 7 upwards and backwards whilst pivoting around the shaft 39. Throughout this entire process the pressure roller 19 remains in position against the web and against the roll 1′, 1, and as a result of the geometric shape of unit 10 after the initial stage the brush 16 ceases to make contact with the roll. This takes place only after a few turns have been wound on, corresponding to a layer of material about 10 mm thick on one prototype which has been manufactured. This rapid reaction is due to the geometric orientation of the pressure roller 19 relative to the roll spindle 4. As indicated by FIG. 1, during the initial stage the spindle 4 is in front of and only slightly lower than roller 19. Since the former cannot be pressed rearwards, hence even only a slight increase in the diameter of roll 4 will in the initial stage result in a relatively marked elevation of roller 19, so that the levers 7 will pivot around the axis 39 and the brush 16 be removed from the roll as the latter increases in size. During the progress of the winding-up process the tension in the web 9 is controlled in accordance with the programme which has been fed into the computer and with the aid of the measured values from the impulse emitters 14 and 15, as described above. In the meantime the roll 2 on which winding has been completed is removed and an empty roll spindle 3 is inserted in the right-hand position in roll holder 5.

When the roll 1 on spindle 4, see FIG. 1, has reached a diameter corresponding roughly to the desired final diameter of the roll, levers 7 are raised by cylinder 8, levers 32 are raised to the rear by cylinders 18 and the roll is transferred, during continued controlled drive of spindle 4, by the roll holder 5 being pivoted one-half a revolution from the left-hand "position 4" to "position 3" by rotation around the drive shaft 6 which is mounted in the right-hand frame end section 37. At the same time the gear housing 44, FIG. 6, is rotated around its centre axis 50 which is coaxial with the drive shaft 6. The gear housing 44 then slides in the supporting and bearing flange 46 in the left-hand frame end section 38. The two wheels 20 and 21 also accompany this rotation around the centre axis 50, this naturally also applying to the gear drives 26 and 27 which are recessed in the left-hand yoke 31' of the roll holder and which interact with roll spindles 3 and 4. On the other hand the drive motors 28 and 29 which are mounted on the left-hand end section 38 remain in their positions.

When roll 1 has thus been transferred to the right-hand position, "spindle position 3", and when a vacant spindle 4 has adopted the left-hand position in the apparatus, the roll spindle 4 is accelerated by its drive motor until it reaches a peripheral speed which corresponds with the speed of the web 9. Prior to to this the surface of spindle 4 has been provided with an adhesive coating. When roll 2 has been fully wound, levers 7 are lowered again by cylinder 8 and the levers 32 of the unit 10 are dropped forwards and downwards by means of cylinders 18 by pivoting the levers 7 about the shaft 40. At the same time as the knife 17 cuts through and cuts off the web 9, the brush 16 and the pressure roller 19 press the cut off web downwards towards roll spindle 4 which then immediately starts to wind up the web on the new roll, completing the working cycle.

I claim:

1. In a method for continuous winding-up of material web on roll spindles where the material web is supplied continuously and the web is arranged to be cut off in conjunction with the shifting of roll spindles, the improvement comprising guiding the web (9), during the winding-up of the web (9) on a first roll spindle (4) in the transportation direction of the web, past a combined pressure-, deflector-, and joining roller (19) fixedly mounted on and carried by a holder (10) and movable therewith at all times, said holder (10) being pivotally mounted on a pair of first levers which can be pivoted about a pivot (39); moving the first levers in response to the diameter of roll (1') which successively increases, by revolution about said pivot (39) as the first roll spindle is in a first position in a roll holder (5) which can be rotated about a pivot (6); pivoting said first levers away from the roll (1') when said roll has achieved approximately its final diameter; rotating the roll holder (5) about its pivot (6) so that a second empty spindle which is provided with an adhesive coating, adopts the position of the first spindle in said first position while the winding-up on the first roll continues in a second position of said first spindle, said web during this phase being guided by contact with the combined roller on said holder (10); accelerating the second spindle to a peripheral speed corresponding to the speed of the web; pivoting said first levers towards the second roller and pivoting said holder (10) so that a knife (17) fixedly mounted on said holder (10) cuts the web substantially simultaneously as the combined pressure roller (19) and a brush (16) or similar member fixedly mounted on the holder in a space between the combined roller and the knife press the cut web against the second spindle which is provided with said adhesive coating, so that the leading end of the web immediately starts being wound-up on the second spindle to a new roll while the cut rear end of the web is wound-up on the first roll, said combined pressure roller (19) remaining in contact with said new roll at least until said brush (16) ceases to make contact with the new roll, due to the new roll increasing in size and said first levers pivoting away from the new roll due to said increase in size.

2. Method according to claim 1, wherein the speed of the fed web (9) and the speed of the roll spindles (4, 3) are measured, that the measured values are fed in digital form to a computer and each of the roll spindles is driven by its own electric motor (28, 29), the speed and torque of which are determined by the same measured values and by desired values which are stored in the computer for the web tension during winding-up and for the speed of the empty spindle onto which the cut off web end is to be wound up.

3. Method as in claim 2, wherein the measured values are obtained from rotating pulse emitters (14, 15, 15A) which transmit signals to the computer in the form of pulse trains, the impulse frequencies of which are proportional to the measured web speed and the measured rotation speed respectively.

4. Method according to claim 2, wherein each of the roll spindles is driven by its own electric drive motor (28, 29) via a gear drive unit in a gear housing (44), the roll spindles are arranged to shift positions by revolving a roll holder (5) in which the roll spindles are mounted, the revolution of the roll holder is performed by revolution around a pivot (6) which is coaxial with the centre axis (50) of the gear drive unit, and the gear drive unit is made to participate in the revolving movement of the roll holder by rotation of the gear housing around the said axis (50) in a frame end section (38) for the roll holder, whilst the said drive motors (28, 29) are mounted on and provided non-displaceable relative to the said end section (38).

5. Method according to claim 3, wherein each of the roll spindles is driven by its own electric drive motor (28, 29) via a gear drive unit in a gear housing (44), the roll spindles are arranged to shift positions by revolving a roll holder (5) in which the roll spindles are mounted, the revolution of the roll holder is performed by revolution around a pivot (6) which is coaxial with the centre axis (50) of the gear drive unit, and the gear drive unit is made to participate in the revolving movement of the roll holder by rotation of the gear housing around the said centre axis (50) in a frame end section (38) for the roll holder, whilst the said drive motors (28, 29) are mounted on and provided non-displaceable relative to the said end section (38).

6. Method according to claim 1, wherein each of the roll spindles is driven by its own electric drive motor (28, 29) via a gear drive unit in a gear housing (44), the roll spindles are arranged to shift positions by revolving a roll holder (5) in which the roll spindles are mounted, the revolution of the roll holder is performed by revolution around a pivot (6) which is coaxial with the centre axis (50) of the gear drive unit, and the gear drive unit is made to participate in the revolving movement of the roll holder by rotation of the gear housing around the said centre axis (50) in a frame end section (38) for the roll holder, whilst the said drive motors (28, 29) are mounted on and provided non-displaceable relative to the said end section (38).

7. Apparatus for continuous winding-up of material web on roll spindles and for cutting the web in conjunction with the shifting of roll spindles, comprising a rotatable roll holder (5) with at least two rotatable spindles (3,4) and driving means for rotating the spindles individually, driving means for rotating the roll holder for the shifting of roll spindle positions, and means for cutting the web and for bringing the leading end of the cut web to contact with an empty roll spindle, comprising a holder (10) fixedly mounting and carrying thereon for movement therewith at all times a cut-off knife (17), a brush (16) or corresponding member and a combined deflector-, joining- and pressure roller (19) extending over the width of the web (9), said holder (10) being pivotable about a pivot (40), and said holder (10) being provided with said pivot (40), said combined roller (19), said brush or corresponding member and said knife being provided in said order in the direction of the web movement so that said brush or corresponding member is provided on the holder between said combined roller and said knife, said holder (10) pivotally attached through said pivot (40) to a pair of shifting levers (7) which in turn are pivotally mounted in frame end sections (37,38) by means of pivots (39) and the combined roller is oriented relative to the shifting levers such that when the roll (1,1') increases in size the levers (7), in the initial stage of increase in size of said roll, are pressed upwards by the geometric orientation of the roll and the pressure roller (19) so that the brush (16) ceases to make contact with the roll.

8. Apparatus as in claim 7, characterised in that the knife and pressure roller (19) are placed in the holder (10) in such a way that when the pressure roller rests against an empty roll spindle (4) in the winding-up position, and the knife is located essentially on the opposite side of the roll spindle (4) from that of pressure roller (19).

9. Apparatus according to claim 8 characterised in that the roll spindles (4, 3) each have their own electric drive motor (28, 29) and that a transmission is provided comprising a gear transmission unit in a gear housing (44) which is mounted in a frame and section (39), that the gear housing is attached to the roll holder (5) and revolvable together with the roll holder around a centre axis (50) which is coaxial or which coincides with the axis of revolution (6) of the roll holder.

10. Apparatus in accordance with claim 9, characterised in that the electric drive motors are mounted on the same frame end section (38) in which the gear housing (44) is mounted.

11. Apparatus in accordance with claim 7, characterised in that said holder is pivotally attached to a pair of shifting levers (7) which in turn are pivotally mounted in frame end sections (37, 38) by means of pivots (30) and that the pressure roller is oriented relative to the shifting levers that when the roll (1, 1') increases in size the levers (7), in the initial stage of the increase in size of said roll, are pressed upwards by the geometric orientation of the roll and the pressure roller (19) so that the brush ceases to make contact with the roll.

12. Apparatus according to claim 7, characterised in that the roll spindles (4, 3) each have their own electric drive motor (28, 29) and that a transmission is provided comprising a gear transmission unit in a gear housing (44) which is mounted in a frame and section (39), that the gear housing is attached to the roll holder (5) and revolvable together with the roll holder around a centre axis (50) which is coaxial or which coincides with the axis of revolution (6) of the roll holder.

13. Apparatus in accordance with claim 12, characterised in that the electric drive motors are mounted on the same frame end section (38) in which the gear housing (44) is mounted.

* * * * *